US006961746B1

(12) United States Patent
Tang

(10) Patent No.: US 6,961,746 B1
(45) Date of Patent: Nov. 1, 2005

(54) CURRENT INTEGRATION CIRCUIT WITH COURSE QUANTIZATION AND SMALL INTEGRATION CAPACITOR

(75) Inventor: Andrew T. K. Tang, Santa Clara, CA (US)

(73) Assignee: Analog Devices, Inc., Norwood, MA (US)

( * ) Notice: Subject to any disclaimer, the term of this patent is extended or adjusted under 35 U.S.C. 154(b) by 562 days.

(21) Appl. No.: 10/170,484

(22) Filed: Jun. 12, 2002

Related U.S. Application Data

(60) Provisional application No. 60/297,960, filed on Jun. 12, 2001.

(51) Int. Cl.[7] ..... G06G 7/18
(52) U.S. Cl. ..... 708/823
(58) Field of Search ..... 708/823

(56) References Cited

U.S. PATENT DOCUMENTS

| | | | | |
|---|---|---|---|---|
| 6,194,703 | B1 * | 2/2001 | Kuderer | 250/214 R |
| 6,300,613 | B1 * | 10/2001 | Kuderer | 250/208.2 |
| 6,621,441 | B2 * | 9/2003 | Haroun et al. | 341/155 |
| 6,781,434 | B2 * | 8/2004 | Jensen et al. | 327/382 |
| 2004/0004488 | A1 * | 1/2004 | Baxter | 324/678 |

OTHER PUBLICATIONS

Dual Current Input 20-Bit Analog-to-Digital Converter, Burr-Brown Products From Texas Instruments, DDC112, 9BAS085A (Jan. 2000), pp. 1-29.
Low Noise, Dual Switched Integrator, Burr-Brown, ACF2101, SBES003, (Sep. 1994) pp. 1-15.
Precision Switched Integrator Transimpedance Amplifier, Burr-Brown, IVC102, (Jun. 1996), pp. 1-11.

* cited by examiner

*Primary Examiner*—Tan V. Mai
(74) *Attorney, Agent, or Firm*—Koppel, Jacobs, Patrick & Heybl

(57) ABSTRACT

A current integration circuit includes an operational amplifier having a capacitor connected between its output and inverting input which integrates an input current. To prevent the op amp's output from becoming saturated, a charge dumping circuit dumps a known charge of the opposite polarity to that stored on the capacitor to the op amp's inverting input, thus reducing the charge on the capacitor and preventing the op amp's output from becoming saturated. A charge dump is triggered whenever the op amp's output exceeds a predetermined trip voltage. Counting the number of charge dumps performed during a given integration period provides a coarse indication of the magnitude of the integrated input current, and the output of the op amp provides a fine indication.

29 Claims, 5 Drawing Sheets

CURRENT INTEGRATION CIRCUIT WITH COURSE QUANTIZATION AND SMALL INTEGRATION CAPACITOR

This application claims the benefit of provisional patent application No. 60/297,960 to Tang, filed Jun. 12, 2001.

BACKGROUND OF THE INVENTION

1. Field of the Invention

This invention relates to the field of current integration circuits.

2. Description of the Related Art

It is often necessary to know the magnitude of a particular current over time. This can be determined with a current integrator.

Current integrators are well-known; a basic implementation is shown in FIG. 1. An operational amplifier A1 receives a current to be integrated $I_{in}$ at its inverting input, with its non-inverting input grounded. A fixed integration capacitor C is connected between the op amp's output and inverting input. A switch SR is connected across capacitor C, which resets the integrator when closed. Input current $I_{in}$ is integrated on capacitor C to produce an output voltage $V_{out}$ from A1.

This arrangement suffers a number of shortcomings, however. If $V_{max}$ is the maximum output voltage that A1 can produce, then the maximum charge $Q_{max}$ that can be stored on integration capacitor C without causing A1's output to become saturated is given by $Q_{max}=V_{max}*C$. The total charge to be integrated is given by $$Q_{total} = \int_0^{T_{int}} I_{in}\, dt$$

(where $T_{int}$ is the integration period), or $Q_{total}=I_{in}\times T_{int}$ if $I_{in}$ is constant. Capacitor C needs to store $Q_{total}$, SO $Q_{max}\geqq Q_{total}$, or $C\geqq Q_{total}/V_{max}$. Thus, to achieve a high $Q_{total}$ requires a large C value to ensure that the amplifier does not saturate. The area used by C can dominate the area of an integrated circuit die.

Another shortcoming of the circuit in FIG. 1 is resolution. If $V_{out}$ were to be sampled by an n-bit analog-to-digital (A/D) converter, the resolution of the integrated charge would be limited to $Q_{max/2}{}^{n}$. One approach to improving the resolution is shown in FIG. 2. An array of integration capacitors such as $C_a$, $C_b$ and $C_c$ are used to allow different integration gains to be selected, using respective switches $S_a$, $S_b$ and $S_c$. However, this arrangement typically requires that the capacitors, and thus the integration gain, be selected before the input current is integrated. If the magnitude of the input current or charge is unknown, it is difficult to select the correct capacitance to provide an integration gain which maximizes the integrator's signal-to-noise ratio. Furthermore, the total integration capacitance needs to be chosen to accommodate the maximum anticipated input charge; i.e., $C_a+C_b+C_c\geqq Q_{total}/V_{max}$. Thus, this design also requires a large die area if a large input charge is to be accommodated.

SUMMARY OF THE INVENTION

A current integration circuit is presented which overcomes the problems noted above. The present circuit can integrate a large input charge, while keeping the integration capacitance small and improving the output resolution when compared with prior art integrators.

The invention includes an operational amplifier which receives an input current to be integrated. An integration capacitor is connected between the op amp's output and inverting input, which integrates the input current and causes the op amp's output voltage to increase or decrease, depending on the direction of the input current.

To prevent the op amp's output from becoming saturated due to a large input current, a charge dumping circuit is employed. The charge dumping circuit is arranged to dump a known charge to the junction of the integration capacitor and the op amp's inverting input. The dumped charge is of the opposite polarity to that stored on the integration capacitor, and thus acts to reduce the charge on the integration capacitor and thereby prevent the op amp's output from becoming saturated. The charge dumping circuit is controlled with a control circuit, which is arranged to trigger a charge dump whenever the op amp's output exceeds a predetermined trip voltage, but before it becomes saturated. Counting the number of charge dumps performed during a given integration cycle provides a coarse indication of the magnitude of the integrated input current, and the output of the op amp—when connected to an analog-to-digital converter (ADC), for example—provides a fine quantization of the integrated current. A high output resolution with large input currents is achieved by combining both coarse and fine quantizations, even if only a small integration capacitor is used.

Further features and advantages of the invention will be apparent to those skilled in the art from the following detailed description, taken together with the accompanying drawings.

DETAILED DESCRIPTION OF THE INVENTION

Figure 3:
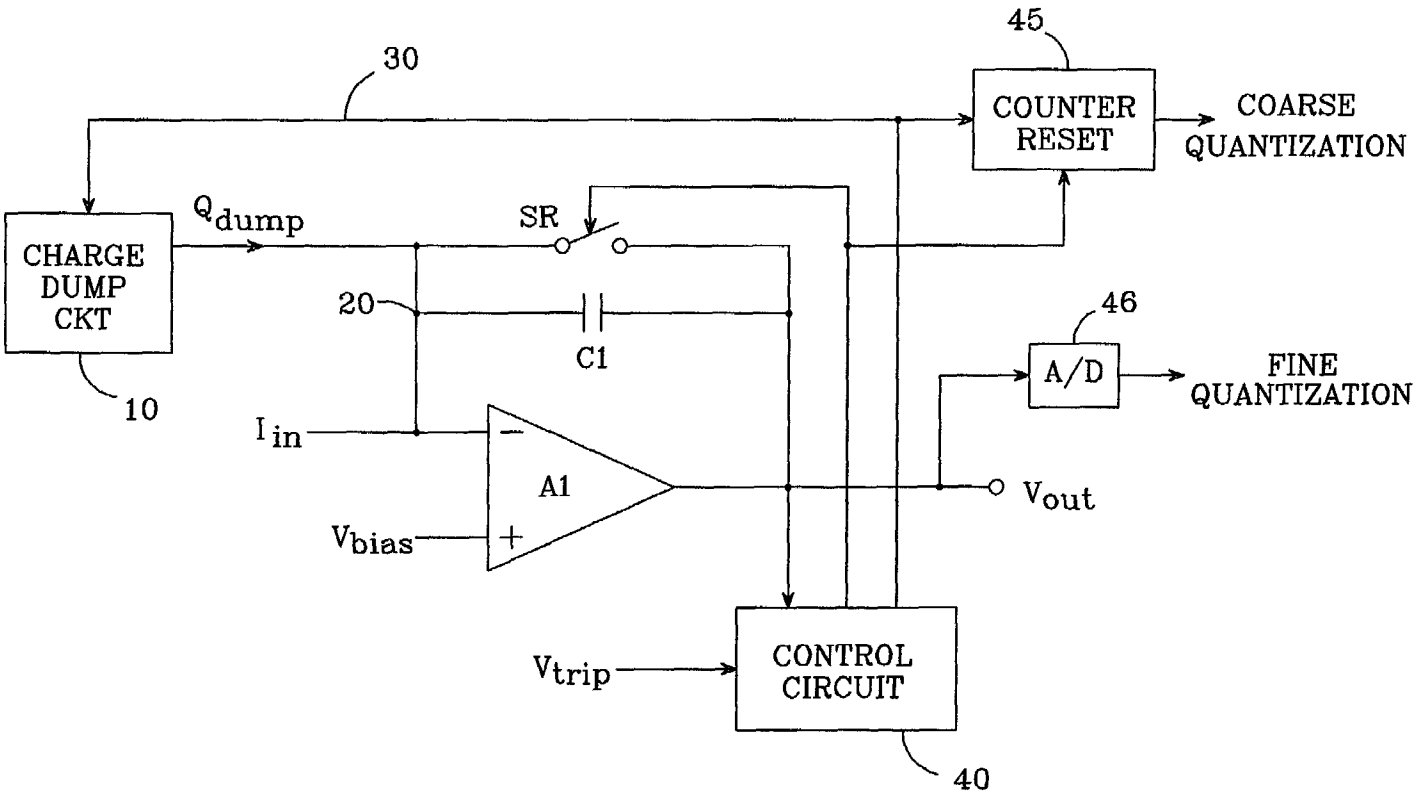
FIG. 3 is a schematic diagram of a current integration circuit in accordance with the present invention.

The basic principles of a current integration circuit per the present invention are illustrated in FIG. 3. An input current $I_{in}$ to be integrated is connected to the inverting input of an operational amplifier A1; A1's non-inverting input is connected to a bias voltage $V_{bias}$ (e.g., ground). An integration capacitor C1 is connected between A1's output and inverting input. Input current $I_{in}$ is integrated on C1, which results in an output voltage $V_{out}$ being produced by A1.

There is a maximum output voltage which A1 is capable of producing. If $I_{in}$ is large and C1 is small, A1's output can become saturated; when this occurs, $V_{out}$ no longer accurately represents the value of $I_{in}$ over time. To prevent A1's output from becoming saturated, the present current integration circuit includes a charge dump circuit 10. Circuit 10 is arranged to dump a known charge $Q_{dump}$ to the junction 20 of A1's inverting input and C1, in response to a control signal 30. The known charge is of opposite polarity with respect to the charge stored on C1, such that when $Q_{dump}$ is dumped to junction 20, the charge stored on integration capacitor C1 is reduced, as is output voltage $V_{out}$.

Control signal 30 is provided by a control circuit 40, which receives the output $V_{out}$ from A1 at one input, and a trip voltage $V_{trip}$ at a second input. Control circuit 40 is arranged to trigger charge dump circuit 10 as necessary to prevent A1's output from saturating. It does this by triggering a charge dump each time $V_{out}$ exceeds trip voltage $V_{trip}$, which is set to a voltage that is less than A1's saturation voltage. In this way, A1's output is kept out of saturation, and the integration of input current $I_{in}$ is not interrupted.

The current integration circuit is arranged to integrate the input current over an integration period $T_{int}$. The number of times that $Q_{dump}$ is dumped during $T_{int}$ provides a coarse indication of the magnitude of the integrated input current. The number of times that $Q_{dump}$ is dumped during $T_{int}$ is tracked by a counting means 45, such as a digital counter which is incremented every time that control circuit 40 triggers charge dump circuit 10. This count, when multiplied by the magnitude of charge $Q_{dump}$ (using, for example, a microprocessor), provides a coarse quantization of the integrated input current.

The output of op amp A1 then provides a fine indication of the input current magnitude, and feeding A1's output to an A/D converter, for example, provides a fine quantization. By combining both coarse and fine quantizations, a high output resolution with large input currents is achieved—even if only a small integration capacitor (occupying a correspondingly small die area) is used.

Figure 1:
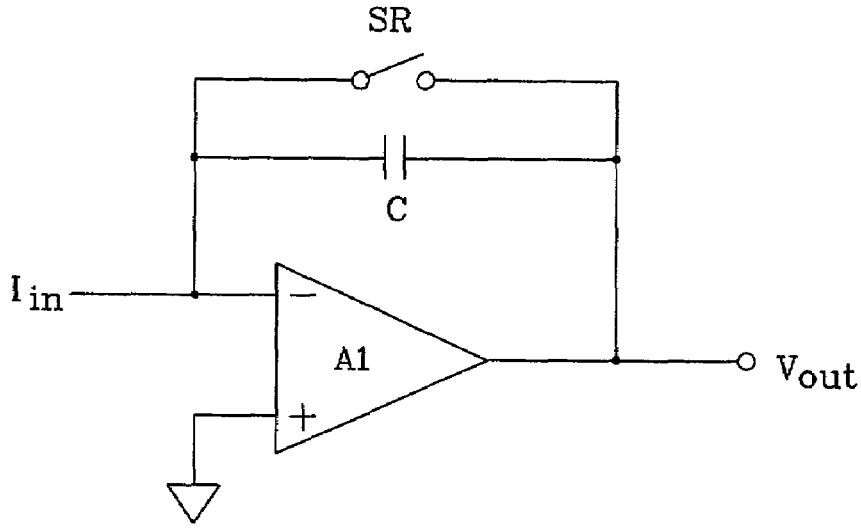
FIG.1 (Prior Art)
FIG. 1 is a schematic diagram of a known current integrator.
Figure 2:
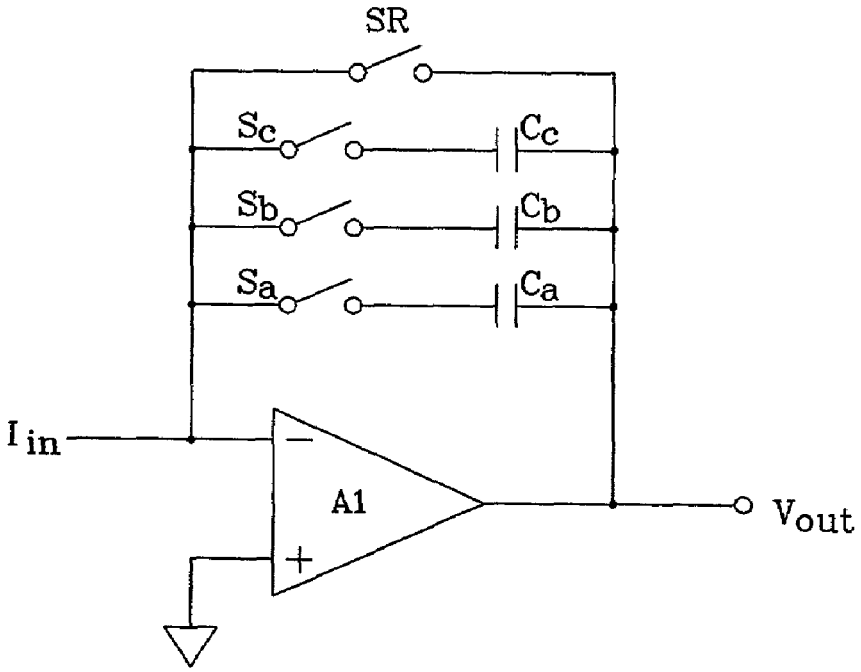
FIG.2 (Prior Art)
FIG. 2 is a schematic diagram of another known current integrator.

In the prior art current integration circuits described above, the integration capacitance had to be equal to or greater than $Q_{total}/V_{max}$ to store $Q_{total}$ (defined above). However, when arranged in accordance with the present invention, integration capacitor C1 can be less than $Q_{total}/V_{max}$ with the smaller capacitor requiring a smaller die area. For example, if $C1=Q_{total}/(16*V_{max})$, then the integrator's output resolution is increased by 16 times (4 bits) for a given A/D converter, and the capacitance of C1 can be 16 times smaller than the capacitance in the circuits shown in FIGS. 1 and 2.

The present invention preferably includes a reset switch SR, which is connected between the op amp's output and inverting input and is controlled by control circuit 40. In operation, prior to integrating $I_{in}$, reset switch SR is closed and counting means 45 is reset, thereby resetting integration capacitor C1 and the charge dump count. Switch SR is then opened, allowing input current $I_{in}$ to be integrated using C1. If $I_{in}$ is such that A1's output approaches saturation, control circuit 40 triggers charge dump circuit 10 as needed, in the manner described above.

Figure 4:
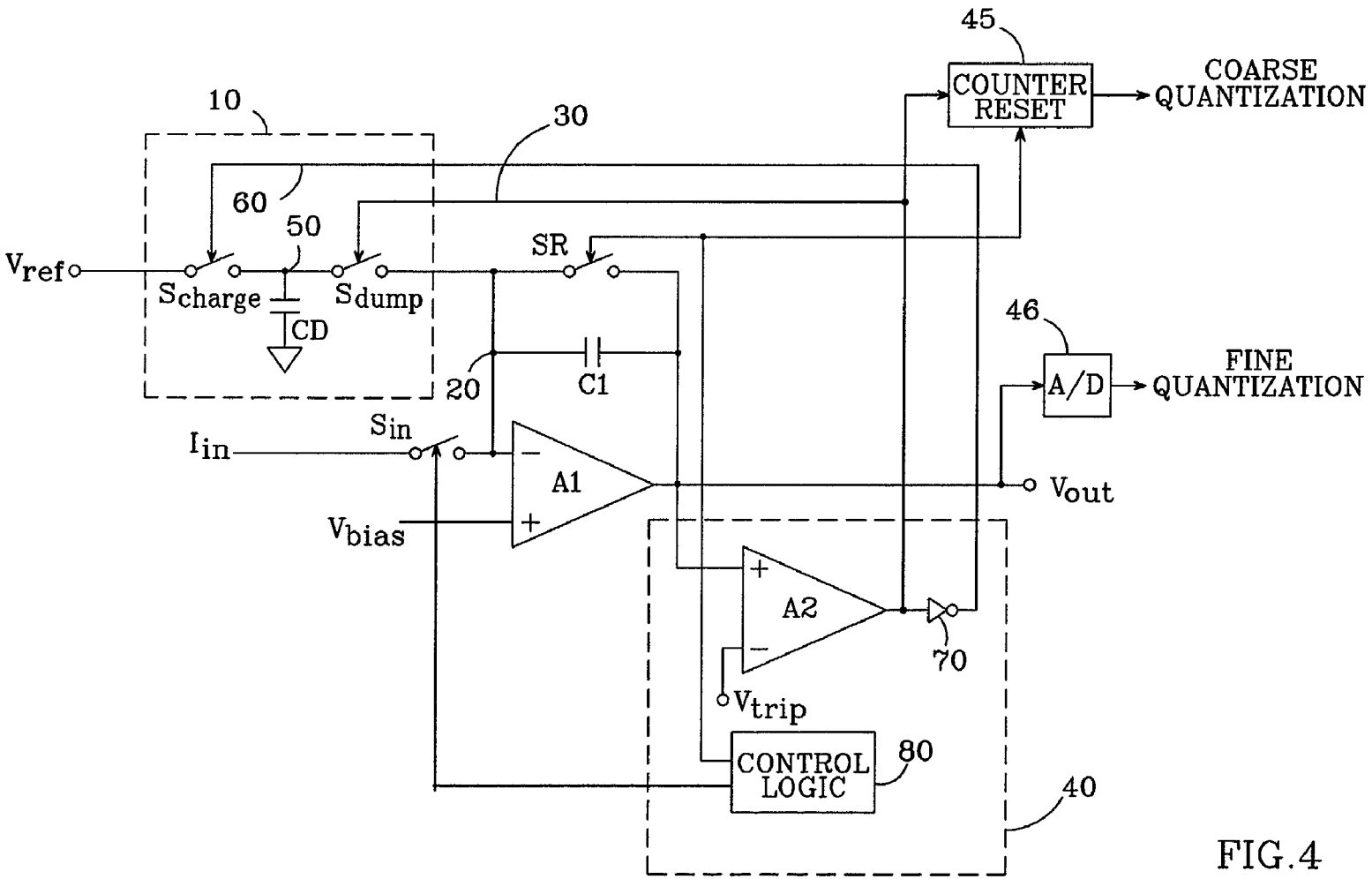
FIG. 4 is a schematic diagram of a basic embodiment of a current integration circuit in accordance with the present invention.

A basic embodiment of the invention is shown in FIG. 4. Op amp A1, integration capacitor C1, and reset switch SR are as described above; an input switch $S_{in}$ is connected between the input current to be integrated ($I_{in}$) and A1's input.

Charge dump circuit 10 comprises a first switch $S_{charge}$, a second switch $S_{dump}$, and a dump capacitor CD. Switch $S_{charge}$ is arranged to connect a reference voltage $V_{ref}$ to a junction 50 when closed, and switch $S_{dump}$ is arranged to connect junction 50 to junction 20 when closed. Dump capacitor CD is connected between junction 50 and ground. Switch $S_{dump}$ receives control signal 30 from control circuit 40, and switch $S_{charge}$ receives another control signal 60 from control circuit 40. Charge dump circuit 10 is operated by first closing $S_{charge}$ to initialize CD by storing charge $Q_{dump}$ on capacitor CD, and then closing $S_{dump}$ to dump charge $Q_{dump}$ to junction 20.

As configured in FIG. 4, charge $Q_{dump}$ on capacitor CD must be of the opposite polarity to that stored on C1, so that when dumped to junction 20, the charge stored on C1 is reduced by $Q_{dump}$. This has the effect of reducing output voltage $V_{out}$ and thereby keeping A1's output out of saturation.

The magnitude of $Q_{dump}$ is given by $CD \times V_{ref}$. To match the coarse quantization provided by the current integration circuit to the fine quantization provided by the A/D converter, $V_{ref}$ is preferably equal to the A/D converter's reference voltage. When $Q_{dump}$ is dumped to junction 20, the voltage across C1 is lowered by $V_{ref} \times (CD/C1)$. CD is preferably smaller than C1, so that A1's output does not change polarity when $S_{dump}$ closes.

As previously mentioned, $Q_{dump}$ must have the opposite polarity to $I_{in}$ in order to discharge C1. Thus, the circuit of FIG. 4 can be used when $I_{in}$ is flowing away from A1's inverting input and $V_{ref}$ is positive, or when $I_{in}$ flows towards A1's inverting input and $V_{ref}$ is negative.

Control circuit 40 preferably comprises a comparator A2 which receives $V_{out}$ at one input and $V_{trip}$ at a second input; A2's output, for example, goes high ("toggles") when $V_{out}$ exceeds $V_{trip}$, and goes low when $V_{out}$ falls back below $V_{trip}$. The output of A2 is control signal 30; when $V_{out}$ exceeds $V_{trip}$, A2's output toggles and closes $S_{dump}$, dumping $Q_{dump}$ to junction 20. Control circuit 40 also preferably includes an inverter 70, which inverts the output of comparator A2 to produce the control signal 60 which operates $S_{charge}$. Thus, for example, when $V_{out}$ is less than $V_{trip}$, A2's output is low and the output of inverter 70 is high, which closes $S_{charge}$ and allows CD to be charged by $V_{ref}$. Then, when $V_{out}$ exceeds $V_{trip}$, A2's output goes high and the output of inverter 70 goes low, which causes $Q_{dump}$ to be dumped to junction 20, reducing the charge stored on C1. Note that the output of A2 needs to be delayed to ensure enough time for $Q_{dump}$ to be fully transferred from CD to C1 before $S_{dump}$ is opened and $S_{charge}$ is closed. Means for achieving this are not shown, but are well-known to those of ordinary skill in the art of analog circuit design. This cycle is repeated as necessary throughout an integration period.

Control circuit 40 also preferably includes control logic 80, which provides control signals to operate reset switch SR and input switch $S_{in}$, and to reset counting means 45.

As noted above, the number of times that charge $Q_{dump}$ is dumped to junction 20 during an integration period $T_{int}$, multiplied by $Q_{dump}$, gives a coarse quantization of the integrated current. The number of charge dumps can be tracked with a counting means 45 such as a digital counter, which counts the number of times that A2's output toggles.

A1's output is preferably provided to an A/D converter 46 to provide a fine quantization of the integrated current. To avoid saturating A/D converter 46, $V_{out}$ should be less than the A/D's reference voltage $V_{ref}$; therefore, $V_{trip}$ should be made less than or equal to $V_{ref}$.

Although the circuit in FIG. 4 illustrates the invention's basic operating principles, it suffers from a shortcoming in that it is difficult to implement CD accurately. This is due to the presence of additional (parasitic) capacitances from junction 50 to ground, which arise due to $S_{charge}$, $S_{dump}$, and wiring.

Figure 5:
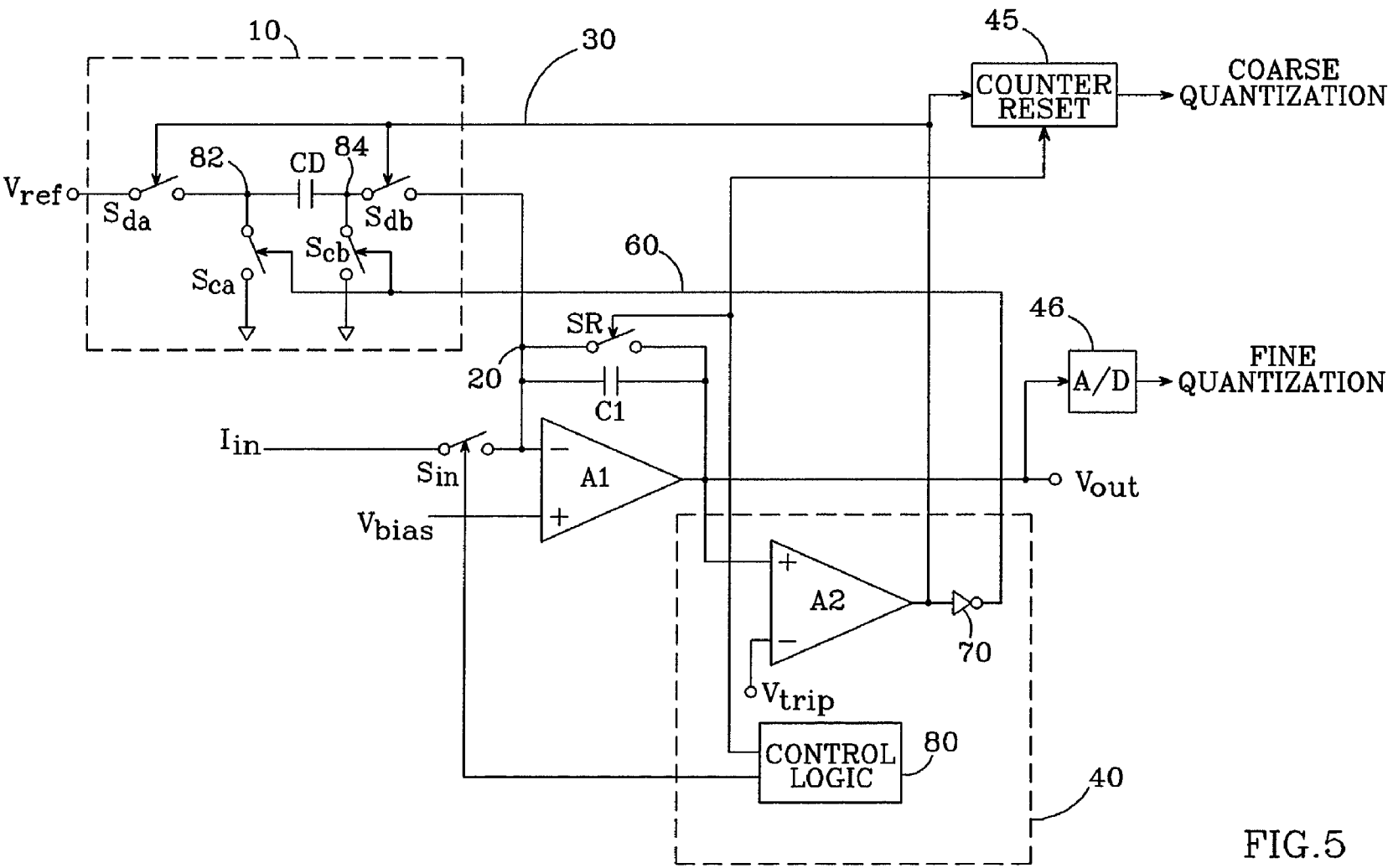
FIG. 5 is a schematic diagram of a preferred embodiment of a current integration circuit in accordance with the present invention.

This problem is overcome in FIG. 5, which illustrates a preferred embodiment of charge dump circuit 10. A switch $S_{da}$ is connected between $V_{ref}$ and the first node 82 of capacitor CD, and a switch $S_{ca}$ is connected between node 82 and ground. A switch $S_{cb}$ is connected between ground and the second node 84 of capacitor CD, and a switch $S_{db}$ is connected between node 84 and junction 20.

Switches $S_{ca}$ and $S_{cb}$ are operated with control signal 60, and switches $S_{da}$ and $S_{db}$ are operated with control signal 30. In operation, when $V_{out}$ is (for example) less than $V_{trip}$, $S_{ca}$ and $S_{cb}$ are closed by signal 60, initializing CD by discharging it. When $V_{out}$ exceeds $V_{trip}$, $S_{ca}$ and $S_{cb}$ are opened and $S_{da}$ and $S_{db}$ are closed (by signal 30), such that a charge $Q_{dump}$ (given by CD×$V_{ref}$) flows from C1 to CD. $V_{ref}$ is selected so that $Q_{dump}$ has the opposite polarity with respect to the charge stored on C1, so that dumping $Q_{dump}$ has the effect of reducing the charge stored on C1 by $Q_{dump}$. This configuration is insensitive to parasitic capacitances from junctions 82 or 84 to ground. When so arranged, the control circuit 40 operates in the following sequence:

provide control signal to close switch SR and thereby discharge the integration capacitor, and to reset counter 45 to zero, provide control signal 60 to close switches $S_{ca}$ and $S_{cb}$ such that charge dump capacitor CD is initialized, provide control signal to close input switch $S_{in}$, thereby beginning an integration period $T_{int}$, and provide control signal 30 and thereby dump charge $Q_{dump}$ whenever $V_{out}$ exceeds $V_{trip}$. An integration period is terminated by either opening $S_{in}$ or closing SR.

Figure 6:
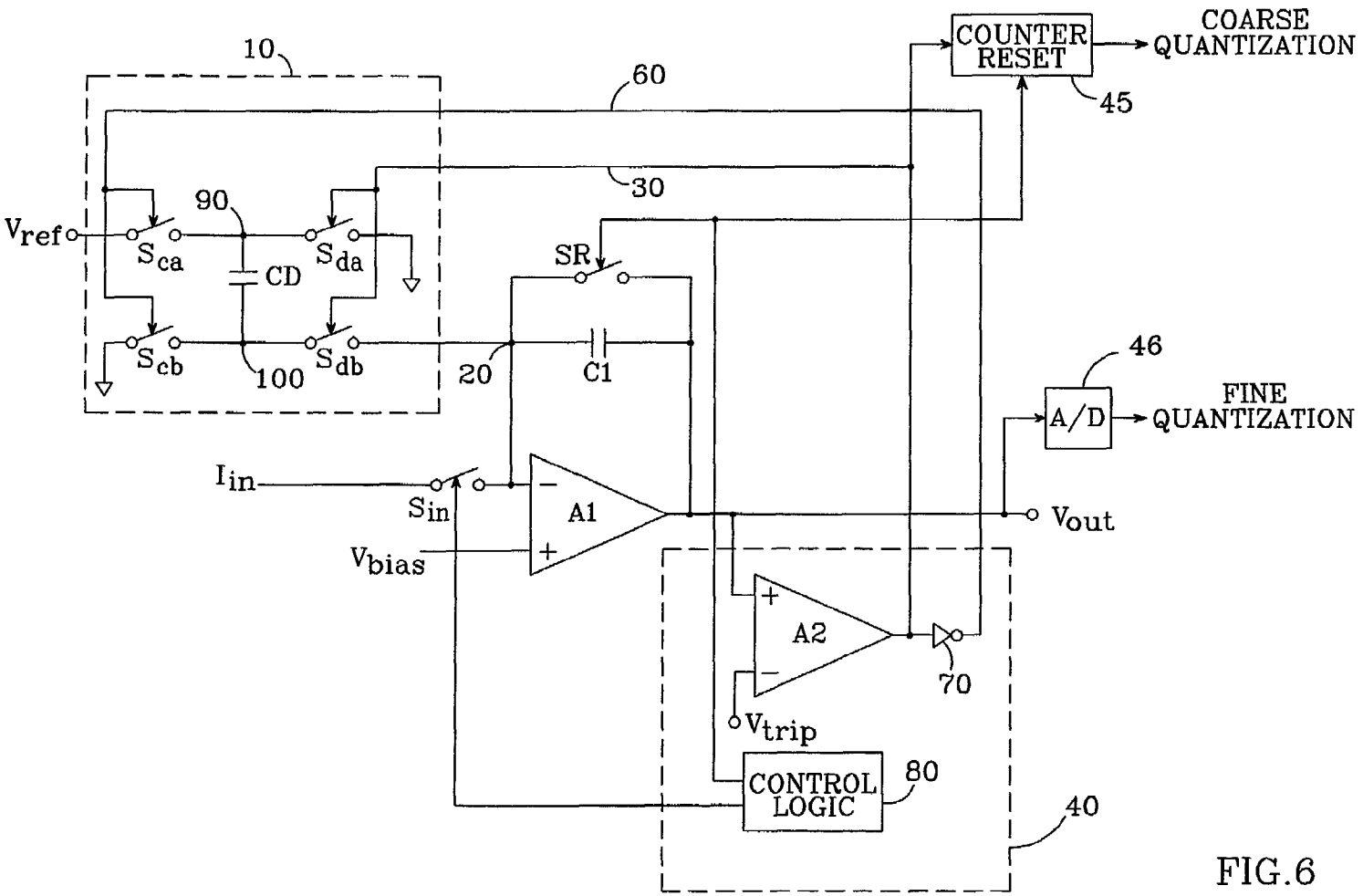
FIG. 6 is a schematic diagram of an alternative embodiment of a current integration circuit in accordance with the present invention.

If $I_{in}$ flows toward A1's inverting input and $V_{ref}$ is positive, or if $I_{in}$ flows away from A1's inverting input and $V_{ref}$ is negative, the polarity of the charge dumped by the circuit of FIG. 4 or 5 will not be opposite that of $I_{in}$ and thus the charge stored on C1 will not be reduced. Under these conditions, the polarity of the charge dumped from CD needs to be reversed. FIG. 6 illustrates an implementation of charge dump circuit 10 which accomplishes this. Here, switch $S_{ca}$ is connected between $V_{ref}$ and the top node 90 of capacitor CD, and switch $S_{da}$ is connected between node 90 and ground. Switch $S_{cb}$ is connected between ground and the bottom node 100 of capacitor CD, and switch $S_{db}$ is connected between node 100 and junction 20. Switches $S_{ca}$ and $S_{cb}$ are operated with control signal 60, and switches $S_{da}$ and $S_{db}$ are operated with control signal 30. In operation, when $V_{out}$ is less than $V_{trip}$, $S_{ca}$ and $S_{cb}$ are closed (by signal 60), initializing CD by charging it to $V_{ref}$ as in FIG. 4. When $V_{out}$ exceeds $V_{trip}$, $S_{ca}$ and $S_{cb}$ are opened and $S_{da}$ and $S_{db}$ are closed (by signal 30). This causes CD to be reversed when discharging into junction 20, thereby reversing the polarity of $Q_{dump}$. The circuit in FIG. 6 is also insensitive to parasitic capacitances from junction 90 to ground and from junction 100 to ground.

The charge dump circuits of FIGS. 5 and 6 are most useful when $I_{in}$ is unidirectional. If $I_{in}$ is bidirectional, charge dump circuit 10 could be arranged to provide a $Q_{dump}$ of either polarity, by including both the FIG. 5 and FIG. 6 implementations, for example, with additional circuitry (not shown) used to detect the direction of $I_{in}$, and to operate charge dump circuit 10 as necessary to ensure that the charge stored on C1 is reduced by $Q_{dump}$.

Dumping $Q_{dump}$ into A1's inverting input causes its output to change quickly, which in turn causes transient voltages to appear back at A1's inverting input. It may be desirable to limit the magnitude of these transients at A1's input, because the linearity of the input current source (such as a photodiode) might be impaired.

One way in which such transients can be limited is to release $Q_{dump}$ slowly by limiting the slew rate of control signal 30 provided to dump switches $S_{dump}$, $S_{da}$ and $S_{db}$—assuming that the switches are such that the resistance between its signal terminals changes continuously with the magnitude of the control signal (as with a FET switch). This can be accomplished with an RC network (not shown), for example, which is interposed between the output of comparator A2 and the control input of switches $S_{dump}$, $S_{da}$ and $S_{db}$.

Alternatively, the rate at which $Q_{dump}$ is dumped could be limited by making switches $S_{dump}$, $S_{da}$ and $S_{db}$ with a larger resistance, using a FET with a small width, for example, to limit the magnitude of voltage transients at A1's inverting input. This resistance could be further increased by interposing a series resistor between $S_{dump}$ and $S_{db}$, and junction 20.

Another way in which the effect of voltage transients on the input current source can be reduced is by opening switch $S_{in}$ for a brief period when $Q_{dump}$ is dumped into C1 to isolate the current source from the integration circuit. When switch $S_{in}$ is temporarily opened, the input current will be integrated across the capacitance of the input current source, but this charge will be transferred to C1 when switch $S_{in}$ is closed again.

Note that the embodiments of control circuit 40 shown in FIGS. 4, 5 and 6 are merely exemplary; many other circuits could be used to detect the impending saturation of A1's output and to control charge dump circuit 10 accordingly to prevent saturation.

Switches $S_{charge}$, $S_{dump}$, $S_{ca}$, $S_{cb}$, $S_{da}$, $S_{db}$, SR and $S_{in}$ are preferably FET switches. The gate of each FET serves as the switch's control input, and its drain and source serve as the switch's signal terminals. The control signals provided by control circuit 40 are preferably arranged to turn on their respective FET switches such that the resistance between their signal terminals is reduced to near zero. Note that other types of switches, including electromechanical switches, could also be used—as long as they are switchable by means of a control signal and present a near-zero resistance between their signal terminals when closed.

While particular embodiments of the invention have been shown and described, numerous variations and alternate embodiments will occur to those skilled in the art. Accordingly, it is intended that the invention be limited only in terms of the appended claims.

I claim:

1. A current integration circuit, comprising:

an operational amplifier having its inverting input connected to receive an input current to be integrated, an integration capacitor C1 connected between said op amp's output and inverting input, said op amp and C1 arranged such that said input current is integrated on C1, a charge dumping circuit arranged to dump a known charge ($Q_{dump}$) to the junction (J1) of C1 and said op amp's inverting input in response to a control signal, $Q_{dump}$ having the opposite polarity with respect to the charge stored on C1, a control circuit arranged to allow said input current to be integrated on C1 for an integration period $T_{int}$, said control circuit further arranged to provide said control signal to said charge dumping circuit such that $Q_{dump}$ is dumped to junction J1 when said op amp's output exceeds a predetermined trip voltage but before it becomes saturated so that $Q_{dump}$ reduces the charge stored on C1 and thereby prevents said op amp's output from saturating, and a counting means for counting the number of times $Q_{dump}$ is dumped to said junction J1 during a given $T_{int}$ and thereby providing a coarse indication of the magnitude of said integrated input current.

2. The current integration circuit of claim 1, further comprising a reset switch connected between said op amp's output and inverting input, said control circuit arranged to close said reset switch and thereby discharge C1 prior to the start of each integration period.

3. The current integration circuit of claim 1, further comprising an input switch connected between said input current and said op amp's inverting input, said control circuit arranged to close said input switch to begin each integration period.

4. The current integration circuit of claim 3, wherein said input current is provided by an input current source and said control circuit is further arranged to provide a control signal to open said input switch for a brief period when $Q_{dump}$ is dumped into C1 such that transient voltages which arise at said op amp's inverting input due to the dumping of said known charges are isolated from said input current source.

5. The current integration circuit of claim 1, wherein said charge dumping circuit comprises:

a first switch $S_{charge}$ having first and second signal terminals and a control input, said first terminal connected to a reference voltage $V_{ref}$, a second switch $S_{dump}$ having first and second signal terminals and a control input, $S_{dump}$'s first terminal connected to $S_{charge}$'s second terminal at a junction J2 and $S_{dump}$'s second terminal connected to said junction J1, and a charge dump capacitor (CD) connected between said junction J2 and ground, said control circuit arranged to provide a control signal to close $S_{charge}$ such that CD is charged by $V_{ref}$ to $Q_{dump}$ when said op amp's output is less than said predetermined trip voltage, and to provide a control signal to close said $S_{dump}$ such that $Q_{dump}$ is dumped to junction J1 when said op amp's output exceeds said predetermined trip voltage.

6. The current integration circuit of claim 5, wherein said control circuit comprises a comparator which receives said op amp's output voltage at one input and said predetermined trip voltage at its second input and which toggles from a first state to a second state when said op amp's output exceeds said predetermined trip voltage and toggles from said second state to said first state when said op amp's output falls below said predetermined trip voltage, $S_{dump}$'s control input connected to said comparator output such that $S_{dump}$ is closed and $Q_{dump}$ is dumped to junction J1 when said comparator output toggles from said first state to said second state.

7. The current integration circuit of claim 6, further comprising an inverter connected to invert said comparator's output, said inverted output connected to $S_{charge}$'s control input such that $S_{charge}$ is closed and CD is charged by $V_{ref}$ when the output of said comparator toggles from said second state to said first state.

8. The current integration circuit of claim 5, wherein each of said switches comprises one or more field-effect transistors (FET).

9. The current integration circuit of claim 1, wherein the rate at which $Q_{dump}$ is dumped is limited such that the magnitude of transient voltages which arise at said op amp's inverting input due to the dumping of said known charges is reduced.

10. The current integration circuit of claim 1, wherein said counting means is a digital counter which is reset in response to a control signal and is incremented each time said known charge is dumped, said control circuit further arranged to provide said control signal to reset said counter prior to the start of each integration period.

11. The current integration circuit of claim 1, further comprising an analog-to-digital (A/D) converter which converts the output of said op amp to a digital value and thereby provide a fine quantization of the magnitude of said integrated input current.

12. The current integration circuit of claim 1, wherein said charge dumping circuit comprises:

a first switch $S_{ca}$ having first and second signal terminals and a control input, said first terminal connected to a reference voltage $V_{ref}$, a second switch $S_{da}$ having first and second signal terminals and a control input, $S_{da}$'s first terminal connected to $S_{ca}$'s second terminal at a junction J2 and $S_{da}$'s second terminal connected to ground, a third switch $S_{cb}$ having first and second signal terminals and a control input, $S_{cb}$'s first terminal connected to ground, a fourth switch $S_{db}$ having first and second signal terminals and a control input, $S_{db}$'s first terminal connected to $S_{cb}$'s second terminal at a junction J3 and $S_{db}$'s second terminal connected to junction J1, a charge dump capacitor (CD) connected between junction J2 and junction J3, said control circuit arranged to provide a control signal to close $S_{ca}$ and $S_{cb}$ such that CD is charged by $V_{ref}$ to $Q_{dump}$ when said op amp's output is less than said predetermined trip voltage, and to provide a control signal to close $S_{da}$ and $S_{db}$ said such that the polarity of $Q_{dump}$ is reversed and the reversed-polarity $Q_{dump}$ is dumped to junction J1 when said op amp's output exceeds said predetermined trip voltage.

13. The current integration circuit of claim 12, wherein said control circuit comprises:

a comparator which receives said op amp's output voltage at one input and said predetermined trip voltage at its second input and which toggles from a first state to a second state when said op amp's output exceeds said predetermined trip voltage and toggles from said second state to said first state when said op amp's output falls below said predetermined trip voltage, and an inverter connected to invert said comparator's output, the control inputs of $S_{da}$ and $S_{db}$ connected to said comparator output such that $S_{da}$ and $S_{db}$ are closed and the reversed-polarity $Q_{dump}$ is dumped to junction J1 when said comparator output toggles from said first state to said second state, and the control inputs of $S_{ca}$ and $S_{cb}$ connected to said inverted output such that $S_{ca}$ and $S_{cb}$ are closed and CD is charged by $V_{ref}$ when the output of said comparator toggles from said second state to said first state.

14. The current integration circuit of claim 1, wherein said charge dumping circuit comprises:

a first switch $S_{da}$ having first and second signal terminals and a control input, said first terminal connected to a reference voltage $V_{ref}$, a second switch $S_{ca}$ having first and second signal terminals and a control input, $S_{ca}$'s first terminal connected to $S_{da}$'s second terminal at a junction J2 and $S_{ca}$'s second terminal connected to ground, a third switch $S_{cb}$ having first and second signal terminals and a control input, $S_{cb}$'s second terminal connected to ground, a fourth switch $S_{db}$ having first and second signal terminals and a control input, $S_{db}$'s first terminal connected to $S_{cb}$'s first terminal at a junction J3 and $S_{db}$'s second terminal connected to junction J1, a charge dump capacitor (CD) connected between junction J2 and junction J3, said control circuit arranged to provide a control signal to close $S_{ca}$ and $S_{cb}$ such that CD is discharged when said op amp's output is less than said predetermined trip voltage, and to provide a control signal to close $S_{da}$ and $S_{db}$ such that $Q_{dump}$ is dumped to junction J1 when said op amp's output exceeds said predetermined trip voltage.

15. The current integration circuit of claim 14, wherein said control circuit comprises:

a comparator which receives said op amp's output voltage at one input and said predetermined trip voltage at its second input and which toggles from a first state to a second state when said op amp's output exceeds said predetermined trip voltage and toggles from said second state to said first state when said op amp's output falls below said predetermined trip voltage, and an inverter connected to invert said comparator's output, the control inputs of $S_{da}$ and $S_{db}$ connected to said comparator output such that $S_{da}$ and $S_{db}$ are closed and $Q_{dump}$ is dumped to junction J1 when said comparator output toggles from said first state to said second state, and the control inputs of $S_{ca}$ and $S_{cb}$ connected to said inverted output such that $S_{ca}$ and $S_{cb}$ are closed and CD is discharged when the output of said comparator toggles from said second state to said first state.

16. A current integration circuit, comprising:

an operational amplifier having its non-inverting input connected to a bias voltage and its inverting input connected to receive an input current to be integrated, an input switch $S_{in}$ connected between said input current and said op amp's inverting input which closes and connects said input current to said op amp in response to a first control signal, an integration capacitor C1 connected between said op amp's output and inverting input, a reset switch SR connected between said op amp's output and inverting input which closes and discharges C1 in response to a second control signal, a charge dumping circuit arranged to dump a known charge $Q_{dump}$ to the junction (J1) of C1 and said op amp's inverting input in response to a third control signal, $Q_{dump}$ having the opposite polarity with respect to the charge stored on C1, a control circuit arranged to provide said first and second control signals to $S_{in}$ and SR, respectively, such that said input current is integrated on C1 for an integration period $T_{int}$, and to provide said third control signal to said charge dumping circuit such that $Q_{dump}$ is dumped to junction J1 whenever said op amp's output exceeds a predetermined trip voltage but before it becomes saturated, $Q_{dump}$ reducing the charge stored on C1 and thereby preventing said op amp's output from saturating, and a counting means for counting the number of times $Q_{dump}$ is dumped to said junction J1 during a given $T_{int}$ and thereby providing a coarse indication of the magnitude of said integrated input current.

17. The current integration circuit of claim 16, wherein said charge dumping circuit comprises:

a first switch $S_{charge}$ having first and second signal terminals and a control input, said first terminal connected to a reference voltage $V_{ref}$, a second switch $S_{dump}$ having first and second signal terminals and a control input, $S_{dump}$'s first terminal connected to $S_{charge}$'s second terminal at a junction J2 and $S_{dump}$'s second terminal connected to said junction J1, and a charge dump capacitor (CD) connected between said junction J2 and ground, said control circuit arranged to provide a fourth control signal to close $S_{charge}$ such that CD is charged to $Q_{dump}$ by $V_{ref}$ when said op amp's output is less than said predetermined trip voltage, and to provide said third control signal to close $S_{dump}$ such that $Q_{dump}$ is dumped to junction J1 when said op amp's output is greater than said predetermined trip voltage.

18. The current integration circuit of claim 17, wherein said control circuit is arranged to:

provide said second control signal to close SR and thereby discharge C1, provide said fourth control signal such that CD is charged by $V_{ref}$ to $Q_{dump}$, provide said first control signal to close $S_{in}$ to begin an integration period $T_{int}$, and provide said third control signal and thereby dump $Q_{dump}$ whenever said op amp's output exceeds said predetermined trip voltage.

19. The current integration circuit of claim 17, wherein said control circuit comprises a comparator which receives said op amp's output voltage at one input and said predetermined trip voltage at its second input and which toggles from a first state to a second state when said op amp's output exceeds said predetermined trip voltage, $S_{dump}$'s control input connected to said comparator output such that $S_{dump}$ is closed and $Q_{dump}$ is dumped to junction J1 when said comparator output toggles from said first state to said second state.

20. The current integration circuit of claim 19, further comprising an inverter connected to invert said comparator's output, said inverted output connected to $S_{charge}$'s control input such that $S_{charge}$ is closed and CD is charged by $V_{ref}$ when the output of said comparator toggles from said second state to said first state.

21. The current integration circuit of claim 17, wherein each of said switches comprises one or more field-effect transistors (FET).

22. The current integration circuit of claim 16, wherein the rate at which $Q_{dump}$ is dumped is limited such that the magnitude of transient voltages which arise at said op amp's inverting input due to the dumping of said known charges is reduced.

23. The current integration circuit of claim 16, wherein said input current is provided by an input current source and said control circuit is further arranged to provide a control signal to open said input switch $S_{in}$ for a brief period when $Q_{dump}$ is dumped into C1 such that transient voltages which arise at said op amp's inverting input due to the dumping of said known charges are isolated from said input current source.

24. The current integration circuit of claim 16, wherein said counting means is a digital counter which is reset in response to a control signal and is incremented each time said known charge is dumped, said control circuit further arranged to provide said control signal to reset said counter prior to the start of each integration period.

25. The current integration circuit of claim 16, further comprising an analog-to-digital (A/D) converter which converts the output of said op amp to a digital value, thereby providing a fine quantization of the magnitude of said integrated input current.

26. The current integration circuit of claim 16, wherein said charge dumping circuit comprises:

a first switch $S_{ca}$ having first and second signal terminals and a control input, said first terminal connected to a reference voltage $V_{ref}$, a second switch $S_{da}$ having first and second signal terminals and a control input, $S_{da}$'s first terminal connected to $S_{ca}$'s second terminal at a junction J2 and $S_{da}$'s second terminal connected to ground, a third switch $S_{cb}$ having first and second signal terminals and a control input, $S_{cb}$'s first terminal connected to ground, a fourth switch $S_{db}$ having first and second signal terminals and a control input, $S_{db}$'s first terminal connected to $S_{cb}$'s second terminal at a junction J3 and $S_{db}$'s second terminal connected to junction J1, a charge dump capacitor (CD) connected between junction J2 and junction J3, said control circuit arranged to provide a control signal to close $S_{ca}$ and $S_{cb}$ such that CD is charged by $V_{ref}$ to $Q_{dump}$ when said op amp's output is less than said predetermined trip voltage, and to provide a control signal to close $S_{da}$ and $S_{db}$ said such that the polarity of $Q_{dump}$ is reversed and the reversed-polarity $Q_{dump}$ is dumped to junction J1 when said op amp's output exceeds said predetermined trip voltage.

27. The current integration circuit of claim 26, wherein said control circuit comprises:

a comparator which receives said op amp's output voltage at one input and said predetermined trip voltage at its second input and which toggles from a first state to a second state when said op amp's output exceeds said predetermined trip voltage and toggles from said second state to said first state when said op amp's output falls below said predetermined trip voltage, and an inverter connected to invert said comparator's output, the control inputs of $S_{da}$ and $S_{db}$ connected to said comparator output such that $S_{da}$ and $S_{db}$ are closed and the reversed-polarity $Q_{dump}$ is dumped to junction J1 when said comparator output toggles from said first state to said second state, and the control inputs of $S_{ca}$ and $S_{cb}$ connected to said inverted output such that $S_{ca}$ and $S_{cb}$ are closed and CD is charged by $V_{ref}$ when the output of said comparator toggles from said second state to said first state.

28. The current integration circuit of claim 16, wherein said charge dumping circuit comprises:

a first switch $S_{da}$ having first and second signal terminals and a control input, said first terminal connected to a reference voltage $V_{ref}$, a second switch $S_{ca}$ having first and second signal terminals and a control input, $S_{ca}$'s first terminal connected to $S_{da}$'s second terminal at a junction J2 and $S_{ca}$'s second terminal connected to ground, a third switch $S_{cb}$ having first and second signal terminals and a control input, $S_{cb}$'s second terminal connected to ground, a fourth switch $S_{db}$ having first and second signal terminals and a control input, $S_{db}$'s first terminal connected to $S_{cb}$'s first terminal at a junction J3 and $S_{db}$'s second terminal connected to junction J1, a charge dump capacitor (CD) connected between junction J2 and junction J3, said control circuit arranged to provide a control signal to close $S_{ca}$ and $S_{cb}$ such that CD is discharged when said op amp's output is less than said predetermined trip voltage, and to provide a control signal to close $S_{da}$ and $S_{db}$ such that $Q_{dump}$ is dumped to junction J1 when said op amp's output exceeds said predetermined trip voltage.

29. The current integration circuit of claim 28, wherein said control circuit comprises:

a comparator which receives said op amp's output voltage at one input and said predetermined trip voltage at its second input and which toggles from a first state to a second state when said op amp's output exceeds said predetermined trip voltage and toggles from said second state to said first state when said op amp's output falls below said predetermined trip voltage, and an inverter connected to invert said comparator's output, the control inputs of $S_{da}$ and $S_{db}$ connected to said comparator output such that $S_{da}$ and $S_{db}$ are closed and $Q_{dump}$ is dumped to junction J1 when said comparator output toggles from said first state to said second state, and the control inputs of $S_{ca}$ and $S_{cb}$ connected to said inverted output such that $S_{ca}$ and $S_{cb}$ are closed and CD is discharged when the output of said comparator toggles from said second state to said first state.

* * * * *

UNITED STATES PATENT AND TRADEMARK OFFICE

CERTIFICATE OF CORRECTION

PATENT NO. : 6,961,746 B1
DATED : November 1, 2005
INVENTOR(S) : Andrew T. K. Tang It is certified that error appears in the above-identified patent and that said Letters Patent is hereby corrected as shown below:

Title page, Item [54] and Column 1, line 1,
Title, change "COURSE" to -- COARSE --.

Signed and Sealed this

Twenty-first Day of February, 2006

JON W. DUDAS
*Director of the United States Patent and Trademark Office*